United States Patent [19]

Eaton et al.

[11] 4,422,648

[45] Dec. 27, 1983

[54] CERAMIC FACED OUTER AIR SEAL FOR GAS TURBINE ENGINES

[75] Inventors: Harry E. Eaton, Woodstock; Richard C. Novak, Glastonbury, both of Conn.

[73] Assignee: United Technologies Corporation, Hartford, Conn.

[21] Appl. No.: 389,304

[22] Filed: Jun. 17, 1982

[51] Int. Cl.[3] ..... F01D 11/08

[52] U.S. Cl. ..... 277/53; 277/227; 415/174

[58] Field of Search ..... 277/227, 53; 415/174

[56] References Cited

U.S. PATENT DOCUMENTS

| | | | |
|---|---|---|---|
| 3,001,806 | 9/1961 | Macks | 277/53 |
| 3,126,149 | 3/1964 | Bowers et al. | 415/174 |
| 3,339,933 | 9/1967 | Foster | 277/53 |
| 3,778,184 | 12/1973 | Wood | 415/174 |
| 4,257,735 | 3/1981 | Bradley et al. | 415/174 |
| 4,295,786 | 10/1981 | Bill et al. | 415/174 |
| 4,336,276 | 6/1982 | Bill et al. | 415/174 |

*Primary Examiner*—Robert I. Smith

*Attorney, Agent, or Firm*—Robert C. Walker

[57] ABSTRACT

Outer air seal structures of particular suitability for use in gas turbine engines are disclosed. Techniques for improving resistance to erosion while maintaining good abradability are discussed.

In one particular structure the ceramic facing material of an outer air seal (30) at the leading edge region (36) is densified by a plasma gun to produce a glazed area (52) which is resistant to erosion.

4 Claims, 6 Drawing Figures

CERAMIC FACED OUTER AIR SEAL FOR GAS TURBINE ENGINES

TECHNICAL FIELD

This invention relates to outer air seals of gas turbine engines, and particularly to seals coated with abradable ceramic materials.

The concepts were developed in the gas turbine engine industry for use in the turbine sections of gas turbine engines, but have wider applicability within that industry and others as well.

BACKGROUND ART

In modern gas turbine engines, working medium gases having temperatures in excess of two thousand degress Fahrenheit (2000° F.) are expanded across rows of turbine blading for extraction of power from the flowing medium. A shroud, termed an outer air seal, circumscribes each row of turbine blading to inhibit the leakage of working medium gases over the blade tips.

Outer air seals of some engines are formed of a metallic substrate to which a thermal barrier coating is applied for protection of the seal from the high temperature, working medium gases. Ceramic materials are generally known to be effective thermal insulators and are in wide use in such seal application. As long as the ceramic coating remains intact, the ceramic prevents unacceptable deterioration of the metallic form to which it is adhered.

Durable structures capable of long term, reliable service in the hostile turbine environment are sought. Specific needs are high temperature capability, and good resistance to thermal shock. Additionally, for turbine seal applications the structure must have adequate surface abradability to prevent destructive interference upon the occurrence of rubbing contact of the seal by circumscribed rotor blades and good erosion resistance, particularly at the leading edge of the seal to prevent excessive wear at the incidence of particles entrained in the working medium upon the seal. In some engines the hot working medium gases alone may be erosive.

U.S. Pat. No. 3,091,548 to Dillon entitled "High Temperature Coatings"; U.S. Pat. No. 3,817,719 to Schilke et al. entitled "High Temperature Abradable Material and Method of Preparing Same"; U.S. Pat. No. 3,879,831 to Rigney et al. entitled "Nickel Base High Temperature Abradable Material"; U.S. Pat. No. 3,911,891 to Dowell entitled "Coating for Metal Surfaces and Methods for Application"; U.S. Pat. No. 3,918,925 to McComas entitled "Abradable Seal"; U.S. Pat. No. 3,975,165 to Elbert et al. entitled "Graded Metal-to-Ceramic Structure for High Temperature Abradable Seal Applications and a Method of Producing Said"; U.S. Pat. No. 4,109,031 to Marscher entitled "Stress Relief of Metal-Ceramic-Gas Turbine Seals"; U.S. Pat. No. 4,163,071 to Weatherly et al. entitled "Method for Forming Hard Wear-Resistant Coatings"; and U.S. Pat. No. 4,289,446 to Wallace entitled "Ceramic Faced Outer Air Seal for Gas Turbine Engines" are representative of the known concepts applicable to ceramic faced seals.

Although many of the materials and methods described in the above patents are known to be highly desirable, the structures resulting therefrom have yet to achieve full potential in hostile environment applications. Of particular remaining concern in outer air seal applications is the balance needed for good abradability in response to blade rubbing contact and good erosion resistance to the effects of particles entrained in the working medium stream.

DISCLOSURE OF INVENTION

According to the present invention ceramic facing material of a turbine outer air seal is formed to first surface density or density near the surface at the leading edge of seal and to a lesser surface density downstream thereof such that the area of the first density is more resistant to wear by foreign particle erosion and the area of lesser density is more easily abraded by passing rotor blades in the installed environment.

According to one detailed embodiment of the invention the ceramic facing material is formed of two or more layers of decreasing density with the top, and least dense, layer having a glazed surface at the leading edge region thereof.

A primary feature of the present invention is the high surface density of the ceramic at the leading edge region of the outer air seal. In at least one embodiment high surface density is achieved by glazing an otherwise porous ceramic. Other features of specific embodiments are the porous ceramic in the midregion of the seal and the dense ceramic layer between the porous ceramic and any metallic materials.

A principal advantage of the present invention is reduced susceptibility of the seal to erosion at the leading edge. Particles entrapped in the working medium stream are deflectable from the glazed surface at the leading edge region without serious erosion. Notwithstanding, good abradability over the rotor blade tips is maintained by leaving surface porosity in that region unaffected.

The foregoing and other features and advantages of the present invention will become more apparent from the following description and the accompanying drawing.

BEST MODE FOR CARRYING OUT THE INVENTION

Figure 1:
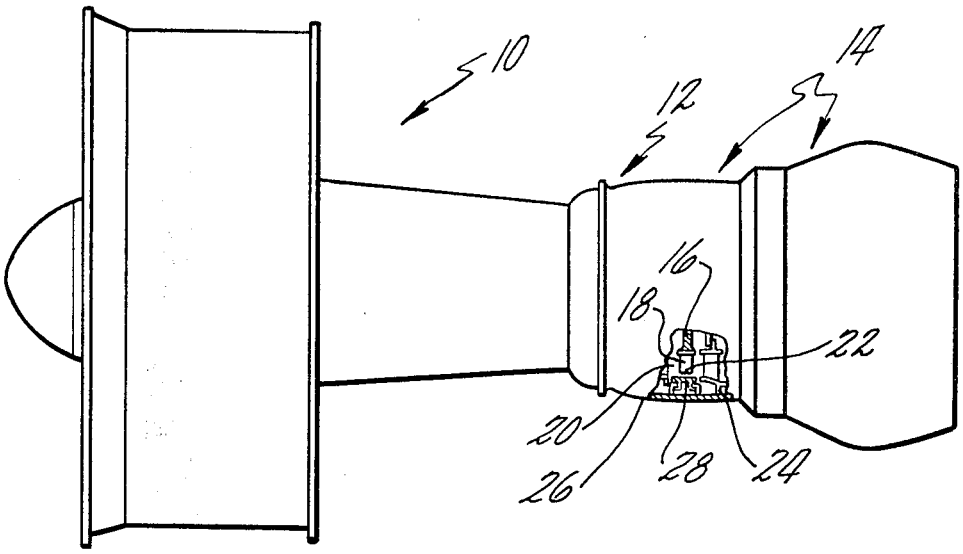
FIG. 1 is a simplified side elevation view of a gas turbine engine with a portion of the turbine casing broken away to reveal the relationship of the outer air seal to the turbine blades.

The invention is described with respect to a preferred turbine outer air seal embodiment for a gas turbine engine. Such an engine is illustrated in FIG. 1.

The engine principally is formed of a compression section 10, a combustion section 12, and a turbine section 14. A rotor assembly 16 extends axially through the engine. Rotor blades, such as the single blade 18 illustrated are arranged in rows and extend outwardly on the rotor assembly across a flowpath 20 for working medium gases. Each rotor blade has a tip 22.

A stator assembly 24 having a case 26 houses the rotor assembly 16. An outer air seal 28 circumscribes the tips 22 of the rotor blades. Each outer air seal is conventionally formed of a plurality of arcuate segments, disposed in end to end relationship about the interior of the engine.

Figure 2:
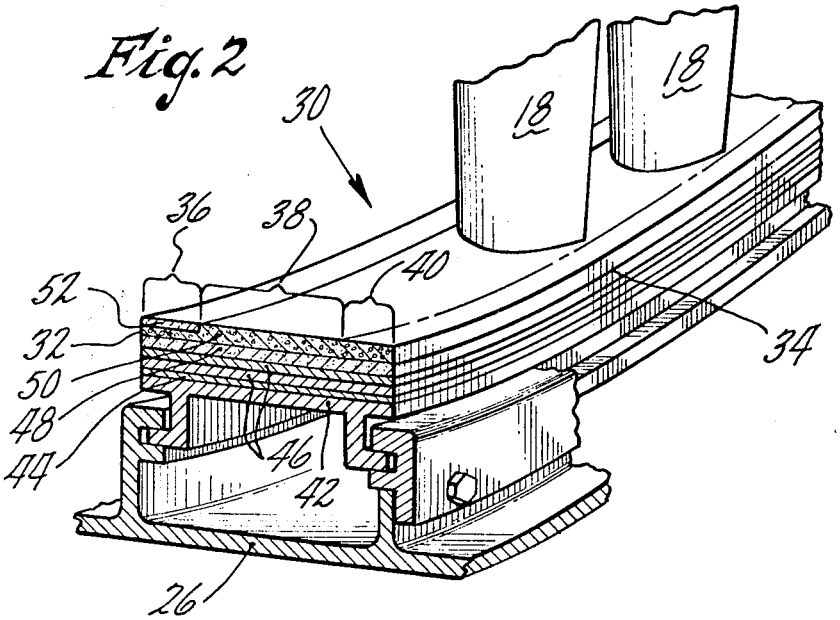
FIG. 2 is a partial perspective view of the outer air seal of FIG. 1 illustrating the area of high surface density at the leading edge region of the seal.

A portion of an outer air seal segment 30 fabricated in accordance with the concepts of the present invention is illustrated in FIG. 2. Working medium gases of the engine flowpath 20 traverse the seal from the upstream end or leading edge 32 to the downstream end or trailing edge 34. For identification purposes the surface of the seal is divided into a leading edge region 36, a midregion 38, and a trailing edge region 40. The midregion essentially comprises that portion of the seal surface which is brushed by the passing rotor blades. The leading edge region is forward of that portion and the trailing edge region is rearward of that portion.

In the illustrated construction each outer air seal segment 30 is formed about a metal substrate 42. Multiple layers of graded metal/ceramic material are adhered to the substrate to produce a ceramic faced seal. As illustrated the multiple layers include a bond coat 44 of nickel-chrome-aluminum alloy, two interlayers 46 of mixed zirconium oxide ($ZrO_2$) and cobalt-chromium-aluminum-yttrium (CoCrAlY) alloy, a dense all ceramic layer 48 of zirconium oxide ($ZrO_2$) and a porous all ceramic layer 50 of zirconium oxide ($ZrO_2$). The layer materials and application techniques are more fully discussed in U.S. patent application Ser. No. 330,401 which is of common assignee herewith.

The purpose of the ceramic layers in an outer air seal structure is twofold: to provide a thermal barrier, shielding the substrate from the hot working medium gases of the turbine to which the substrate would be otherwise exposed, and to provide an abradable seal accommodating thermal excursions of the circumscribed rotor blades without destruction interference. Desired material characteristics include good abradability when struck by passing rotor blades and good resistance to erosion. The two characteristics are not always consistent in identically formulated compositions. Achieving both characteristics in the same structure is the object of the present invention.

Working medium gases of the engine flowpath may contain particles of dirt or other foreign matter and, by the time the medium gases reach the turbine area, may also contain carbon particles from the engine combustor. Such particles as strike the surface of the outer air seal are likely to erode material therefrom, particularly if the material is porous and of moderate or low strength. In some engines the hot gases in and of themselves may be erosive.

It is, therefore, that seals of the present invention are fabricated to include an area 52 of high surface density (density near the surface) ceramic in the leading edge region 36 relative to the surface density of the ceramic in the midregion 38 over the rotor blades. Resistance to erosion is improved without destroying desired abradability over the blade tips.

In the form illustrated by FIG. 2 the area of high surface density is produced by directed energy techniques with localized heating for example by plasma torch or laser. Ceramic at the surface is melted by the directed energy and when cooled forms to a very dense condition and glazed appearance. Particles and gases striking the glazed area deflect from the surface with little erosion.

Figure 3:
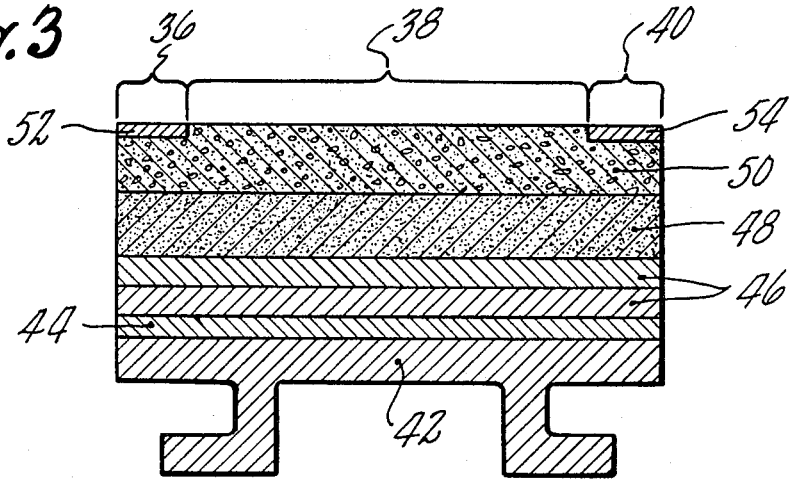
FIG. 3 is a partial perspective view of the outer air seal of FIG. 1 illustrating areas of high surface density at both the leading and trailing edge regions of the seal.

The preferred depth of the glazing or high density material is on the order of five to ten thousands of an inch (0.005–0.010 in.) into the ceramic with especially dense structure at the surface. Greater or lesser depths may be acceptable but the depth must first be sufficient to provide erosion resistance over sufficient part life and second not be so great as to be thermally incompatible with the porous substrate to which it is adhered. Thermal incompatibility is likely to cause lateral cracking at the interface between the glazing and the substrate and resultant spalling of the glazed material. When held to depths within the preferred range a desired vertical crack network in the substrate will likely penetrate the glazed surface and spalling will be avoided. In some embodiments it may also be desirable to similarly produce an area 54 of dense or glazed ceramic at the trailing edge region 40 as shown in FIG. 3.

Figure 4:
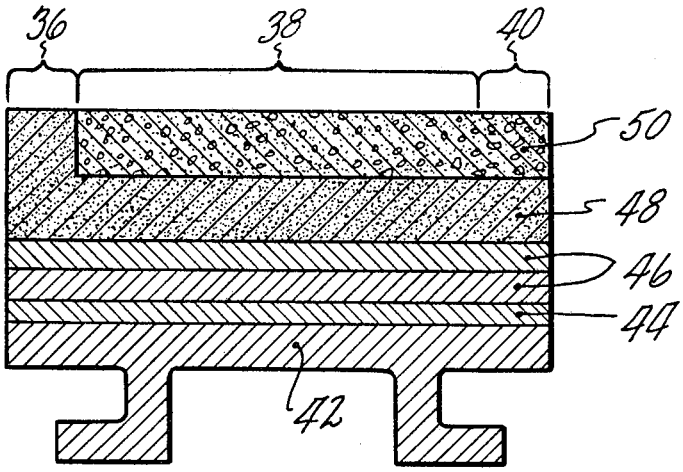
FIG. 4 is one alternate embodiment of the FIG. 2 structure.
Figure 5:
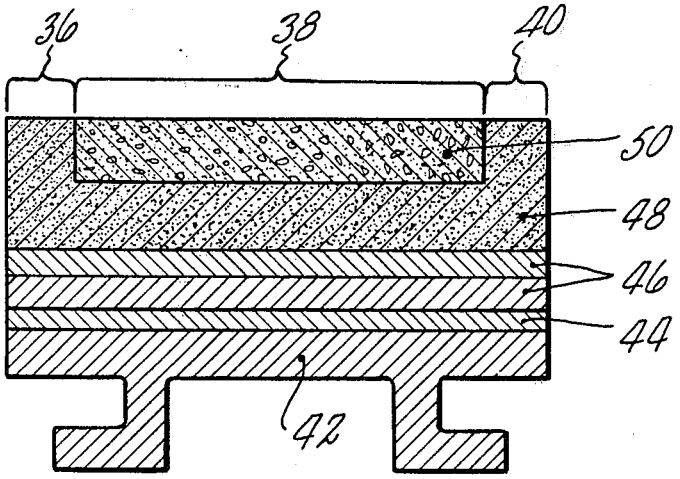
FIG. 5 is one alternate embodiment of the FIG. 3 structure.

The advantages of the present invention may be collaterally achieved in other forms such as the structures illustrated by FIG. 4. Dense ceramic, such as comprises the first ceramic layer 48, is deposited in the leading edge region 36. Porous ceramic in the layer 50 remains over the blade tips. Dense ceramic may also be deposited at the trailing edge region as shown in FIG. 5.

Acceptable densification of zirconium oxide ($ZrO_2$) ceramic has been achieved by plasma gun melting utilizing the METCO® 7mb gun with type GE nozzle under conditions shown in the following table:

| | | |
|---|---|---|
| Gun | | |
| Distance to Workpiece | | 1¼" |
| Current | | 680 amperes |
| Potential | | 75 volts |
| Arc Gas | | |
| Primary | Gas | Nitrogen |
| | Pressure | 50 psi |
| | Flow Rate | 80 CFH |
| Secondary | Gas | Hydrogen |
| | Pressure | 50 psi |
| | Flow Rate | 50 CFH |
| Heat Traverse | | |
| Speed | | 60 ft/min. |
| Number of Passes | | 1 |
| Increment between Passes | | ⅛ inch |
| Substrate Preheat | | |
| Temperature - start | | Room temp. |
| Temperature - finish | | Room temp. |
| Cooling | | None |

Figure 6:
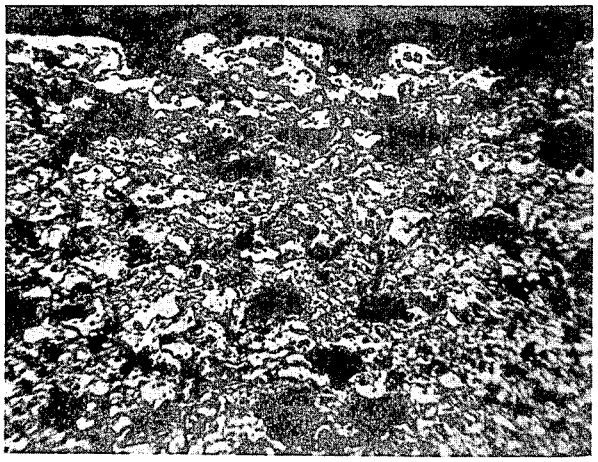
FIG. 6 is a photomicrograph of a ceramic coating which has been surface densified to a depth of approximately five thousandths (0.005) of an inch.

The photomicrograph of FIG. 6 shows the depth of penetration achieved. Densification effects are greatest to a depth of one thousandth (0.001) of an inch with penetration to a depth of approximately five thousandths (0.005) of an inch.

Although the invention has been shown and described with respect to detailed embodiments thereof, it should be understood by those skilled in the art that various changes in form and detail thereof may be made without departing from the spirit and the scope of the claimed invention.

We claim:

1. In an outer air seal of the type circumscribing the turbine rotor blades of a gas turbine engine and having a leading edge region forward of the blades, a midregion opposing the blades and a trailing edge region rearward of the blades, the improvement comprising:

an abradable ceramic coating having higher surface density at the leading edge region of the seal than at the midregion of the seal.

2. The invention according to claim 1 wherein said coating further has a higher surface density at the trailing edge region of the seal than at the midregion of the seal.

3. The invention according to claim 1 or 2 wherein said region of higher density extends to a depth of approximately five to ten thousandths (0.005–0.010) of an inch into the coating.

4. The invention according to claim 3 wherein said abradable ceramic coating is zirconium oxide ($ZrO_2$).

* * * * *